US007059682B2

(12) United States Patent
Caruso et al.

(10) Patent No.: US 7,059,682 B2
(45) Date of Patent: Jun. 13, 2006

(54) SEATING STRUCTURE HAVING FLEXIBLE SEATING SURFACE

(75) Inventors: Jerome Carmel Caruso, Lake Forest, IL (US); Steven Jerome Caruso, Antioch, IL (US)

(73) Assignee: Herman Miller, Inc., Zeeland, MI (US)

( * ) Notice: Subject to any disclaimer, the term of this patent is extended or adjusted under 35 U.S.C. 154(b) by 0 days.

(21) Appl. No.: 10/819,471

(22) Filed: Apr. 7, 2004

(65) Prior Publication Data

US 2005/0001464 A1 Jan. 6, 2005

Related U.S. Application Data

(63) Continuation of application No. 09/897,153, filed on Jun. 29, 2001, now Pat. No. 6,726,285.

(60) Provisional application No. 60/215,257, filed on Jul. 3, 2000.

(51) Int. Cl.
*A47C 7/02* (2006.01)

(52) U.S. Cl. ..... 297/452.46; 297/452.32; 297/452.35; 297/452.21

(58) Field of Classification Search ..... 267/160, 267/131, 80; 428/131, 174, 179; 5/653, 5/652.1; 297/452.46, 452.42, 452.43, 452.21, 297/452.24, 452.32, 452.35, 452.37, 452.44, 297/452.52, 452.13, 452.28; 403/291; 16/225
See application file for complete search history.

(56) References Cited

U.S. PATENT DOCUMENTS

| | | | |
|---|---|---|---|
| 54,314 | A | 5/1866 | Farmer |
| 567,639 | A | 9/1896 | Crouch |
| 662,647 | A | 11/1900 | Howe |
| 1,005,330 | A | 10/1911 | Schmits et al. |
| 1,769,294 | A | 7/1930 | Johnson et al. |
| 2,126,439 | A | 8/1938 | Zerbee |
| 2,260,352 | A | 10/1941 | Trapani |
| 2,878,860 | A | 3/1959 | Brattrud |
| 3,041,109 | A | 6/1962 | Eames et al. |
| 3,059,919 | A | 10/1962 | Marchino |
| 3,080,579 | A | 3/1963 | Gordon |
| 3,107,944 | A | 10/1963 | Baermann |
| 3,117,819 | A | 1/1964 | Kudriavetz, Jr. |
| 3,120,407 | A | 2/1964 | Propst |

(Continued)

FOREIGN PATENT DOCUMENTS

EP 0 021 191 A2 6/1980

(Continued)

OTHER PUBLICATIONS

Digital images of "Ypsilon" chair, date unknown.

(Continued)

*Primary Examiner*—Peter M. Cuomo
*Assistant Examiner*—Sarah B. McPartlin
(74) *Attorney, Agent, or Firm*—Brinks Hofer Gilson & Lione

(57) ABSTRACT

A seating structure includes a plurality of boss structures arranged in a pattern and a plurality of web structures joining adjacent boss structures within the pattern. At least some of the web structures are non-planar and at least some adjacent web structures are spaced apart such that they define openings therebetween. In another aspect, the seating structure includes a plurality of boss structures arranged in a pattern and defining a support surface and a plurality of web structures joining adjacent boss structures within the pattern. At least some adjacent web structures are spaced apart and shaped such that they define substantially non-circular openings therebetween when viewed in a direction substantially perpendicular to the support surface.

15 Claims, 15 Drawing Sheets

U.S. PATENT DOCUMENTS

| | | | | | |
|---|---|---|---|---|---|
| 3,140,086 | A | | 7/1964 | Lawson | |
| 3,162,487 | A | | 12/1964 | Trotman | |
| 3,198,578 | A | | 8/1965 | Geoffrey et al. | |
| 3,217,786 | A | | 11/1965 | Earl | |
| RE25,943 | E | | 12/1965 | Lawson | |
| 3,233,885 | A | | 2/1966 | Propst | |
| 3,514,156 | A | * | 5/1970 | Fields | 297/452.45 |
| 3,565,482 | A | | 2/1971 | Blodee | |
| 3,681,797 | A | | 8/1972 | Messner | |
| 3,720,568 | A | | 3/1973 | Rowland | |
| 3,722,955 | A | * | 3/1973 | Trotman | 297/452.45 |
| 3,767,261 | A | | 10/1973 | Rowland | |
| 3,840,269 | A | | 10/1974 | Ambrose | |
| 3,877,750 | A | | 4/1975 | Scholpp | |
| 4,143,916 | A | | 3/1979 | Trotman | |
| 4,318,556 | A | | 3/1982 | Rowland | |
| 4,367,897 | A | * | 1/1983 | Cousins | 297/284.3 |
| 4,368,917 | A | | 1/1983 | Urai | |
| 4,390,210 | A | | 6/1983 | Wisniewski et al. | |
| 4,435,015 | A | * | 3/1984 | Trotman et al. | 297/452.45 |
| 4,533,174 | A | | 8/1985 | Fleishman | |
| 4,582,361 | A | | 4/1986 | Kennel | |
| 4,585,272 | A | | 4/1986 | Ballarini | |
| 4,660,887 | A | | 4/1987 | Fleming et al. | |
| 4,761,035 | A | | 8/1988 | Urai | |
| 4,789,201 | A | | 12/1988 | Selbert | |
| 4,828,320 | A | | 5/1989 | Saiger | |
| 4,834,458 | A | | 5/1989 | Izumida et al. | |
| 4,856,846 | A | | 8/1989 | Lohmeyer | |
| 4,889,387 | A | | 12/1989 | Gregory | |
| 4,913,493 | A | | 4/1990 | Heidmann | |
| 4,993,164 | A | | 2/1991 | Jacobsen | |
| 5,013,089 | A | | 5/1991 | Abu-Isa et al. | |
| 5,067,772 | A | | 11/1991 | Koa | |
| 5,094,580 | A | | 3/1992 | Abe | |
| 5,154,485 | A | | 10/1992 | Fleishman | |
| 5,249,839 | A | | 10/1993 | Falks et al. | |
| D346,279 | S | | 4/1994 | Stumpf et al. | |
| 5,318,348 | A | | 6/1994 | Hess | |
| 5,320,410 | A | | 6/1994 | Faiks et al. | |
| 5,439,271 | A | | 8/1995 | Ryan | |
| 5,441,331 | A | | 8/1995 | Vento | |
| 5,445,436 | A | | 8/1995 | Kemnitz | |
| 5,529,373 | A | | 6/1996 | Olson et al. | |
| 5,551,673 | A | | 9/1996 | Furusawa et al. | |
| D377,431 | S | | 1/1997 | Stumpf et al. | |
| 5,662,383 | A | | 9/1997 | Hand | |
| 5,747,140 | A | | 5/1998 | Heerklotz | |
| 5,762,403 | A | | 6/1998 | Robinson | |
| 5,833,321 | A | * | 11/1998 | Kim et al. | 297/452.42 |
| 5,934,758 | A | | 8/1999 | Ritch et al. | |
| 6,029,962 | A | | 2/2000 | Shorten et al. | |
| 6,035,901 | A | | 3/2000 | Stumpf et al. | |
| 6,059,368 | A | | 5/2000 | Stumpf et al. | |
| 6,106,063 | A | | 8/2000 | Dauphin | |
| 6,170,808 | B1 | | 1/2001 | Kutschi | |
| 6,193,318 | B1 | | 2/2001 | Becker et al. | |
| 6,254,190 | B1 | | 7/2001 | Gregory | |
| 6,439,665 | B1 | | 8/2002 | Cvek | |
| 6,523,898 | B1 | | 2/2003 | Ball et al. | |
| D471,024 | S | | 3/2003 | Chadwick et al. | |
| D471,042 | S | | 3/2003 | Nicolai et al. | |
| D471,370 | S | | 3/2003 | Schmitz et al. | |
| 6,546,578 | B1 | | 4/2003 | Steinmeier | |
| 6,550,866 | B1 | | 4/2003 | Su | |
| D474,346 | S | | 5/2003 | Saylor et al. | |
| D475,859 | S | | 6/2003 | Kryger | |
| 6,588,842 | B1 | | 7/2003 | Stumpf et al. | |
| 6,623,079 | B1 | | 9/2003 | Gregory | |
| D485,097 | S | | 1/2004 | Raftery | |
| D487,359 | S | | 3/2004 | Giugiaro | |
| 6,726,285 | B1 | | 4/2004 | Caruso et al. | |
| 6,726,286 | B1 | | 4/2004 | Stumpf et al. | |
| D489,191 | S | | 5/2004 | Ma | |
| D489,541 | S | | 5/2004 | Su | |
| D489,542 | S | | 5/2004 | Giugiaro | |
| 6,729,691 | B1 | | 5/2004 | Koepke et al. | |
| D490,994 | S | | 6/2004 | Schmitz et al. | |
| 6,869,140 | B1 | | 3/2005 | White et al. | |
| 2002/0096931 | A1 | | 7/2002 | White et al. | |
| 2005/0001464 | A1 | | 1/2005 | Caruso et al. | |

FOREIGN PATENT DOCUMENTS

| | | |
|---|---|---|
| EP | 0 021 191 B1 | 6/1980 |
| GB | 2225229 A | 5/1990 |
| WO | WO 00/22961 | 4/2000 |

OTHER PUBLICATIONS

Vitra "Ypsilon" brochure, date unknown.
International Search Report, International Application PCT/US02/00024 (May 29, 2002).
"IDEA" advertisement, Intes USA, High Point, NC, single page, date unknown.
"NEW! Bungie Hi-Back Chair" advertisement, source and date unknown.
"Aeron Chair", Herman Miller, 1995 (4 pages).
International Preliminary Examination Report from PCT/US2002/00024, Apr. 12, 2005 (4 pages).
Pearlman, C., "Made to Measure" *I.D.,* Sep.-Oct. 1994 (8 pages).
Zurowski, T., "Designers Rate . . . Herman Miller's Aeron Chair", *Interiors,* Jul. 1995 (1 page).

* cited by examiner

SEATING STRUCTURE HAVING FLEXIBLE SEATING SURFACE

This application is a continuation of U.S. patent application Ser. No. 09/897,153, filed Jun. 29, 2001, now U.S. Pat. No. 6,726,285, which claims the benefit of U.S. Provisional Application No. 60/215,257, filed Jul. 3, 2000, the entire disclosures of which are hereby incorporated herein by reference.

FIELD OF INVENTION

The present invention relates to chairs and seating normally associated with but not limited to residential or commercial office work. These chairs employ a number of methods of to enhance the user's comfort and promote ergonomically healthy sitting. These methods include various forms of padding and flexing of the seat and back as well as separate mechanical controls that control the overall movement of the seat and back.

BACKGROUND OF THE INVENTION

Various approaches to making a chair's seat and back form fitting for various users are known in the industries of seating manufacture. These approaches range from the rather traditional use of contouring synthetic foam, to seat/back shells that have a degree of flex. There have also been approaches that use a frame that has a membrane or sling stretched or supported within said frame. Several problems exist with each of these approaches.

In the case of simply using foam padding, under normal manufacturing conditions it is difficult if not impossible to properly vary the amount of firmness and thus support from one area of a cushion to another. Additionally, having to use foam can lead to excessive heat-build-up between the seating surface and the occupant. One of the problems with foam is the forming/molding of it. Current manufacturing technology makes it a relatively inefficient process compared with the manufacture of the other components that make up a chair of seating surface. The forming/molding of a contoured seating surface is so slow that the manufacturer is forced to make many sets of molds (which usually are hand filled) in order to maintain the production pace. This is contrasted by a part or component that is made for the same piece of furniture yet it can be produced on a single injection-molding machine with a single mold and keep pace. Another problem inherent to the use of foam is that in order to achieve a finished look the cushions must be upholstered. When a manufacturer is forced to upholster a cushion a number of problem issues arise. Usually the formed or molded foam has curves, many of which can be compound-curves, which leads a manufacturer to use glue or other adhesives to make the fabric conform to the contours. This laminating technique often makes the foam's surface firmer than it was when it was originally molded/formed because the glue/adhesive and the fabric are now part of the foam structure. Additionally, the amount of change can vary from fabric to fabric which results in an unpredictability of the firmness of a cushion from one manufactured unit to the next. If a slipcover is used, it must be sized properly. Such sizing can be difficult as a result of the differing mechanical properties found from one fabric to another. The most important properties of a fabric when upholstering a contoured surface are its thickness and its rate of stretch. Thickness variations can make one fabric upholster smooth around radii or contours, while a thicker one will wrinkle in the same area. Variations in the amount of stretch can lead to other problems. And so a proper size slipcover in one type of fabric, with its stretch characteristics, can be the wrong size in another type or style of fabric. Often a manufacturer will "wrap" a piece of fabric around a cushion and then staple the fabric to the underside/backside of the cushion. This approach also suffers from the aforementioned problems associated with using variable fabrics. Additionally, The manufacturer must now cover the staples and the area of the cushion not covered by fabric in order to achieve a finished look. This leads to an additional molding etc. that often also has to be upholstered.

The other reality of cushion upholstery, regardless of the techniques used, is that whether it is done in a small shop or in a production situation, it is consistently the most labor-intensive aspect of chair/seating construction.

In the case of incorporating flex into the shells of a chair, no geometry to date has achieved the proper amount of flex in the right areas to give correct ergonomic comfort for a wide range of individuals. In the case of a sling approach, the curves imparted on the sling by the frame are simple in nature (non-compound) and thus cannot provide the proper contouring necessary for ergonomic comfort. Also, this approach leads to "hammocking". Hammocking is when the sling is pressed in one area; the areas immediately adjacent have the tendency of folding inward, squeezing the occupant, again not yielding the proper ergonomic curvatures. An additional problem with sling chairs is that if the manufacturer makes the supporting sling surface taut enough to properly support a large-heavy person, the tension on the sling will be too great for a smaller person, resulting in discomfort.

Finally, the present state of the art dictates that the contours a designer may choose in seating design be generic in nature to accommodate the widest range of the population possible. In an effort to increase comfort, manufacturers have produced "sized" (i.e. small, medium and large) chairs that effectively narrow the amount of contouring-compromise that the designer must normally exercise. Unfortunately, this leads to the manufacturer having to tool three independent products instead of one, and the manufacturers, wholesalers, and retailers having to stock (in this example) three times the quantity of product. Additionally, the end user is stuck with a chair that at some point in the future may be the wrong size. This invention addresses these shortcomings with a new and novel approach to seating construction.

SUMMARY OF THE INVENTION

The present invention relates to an improved method of constructing seating surfaces, which provides greater comfort through superior surface adjustment for a variety of users. The seating surface construction is comprised of a plurality of support sections, or bosses/platforms and of a plurality of web connectors interconnecting the support sections. The support sections, or bosses/platforms are more rigid than their corresponding web connectors. A variety of methods are disclosed for making the bosses/platforms exhibit a greater degree of rigidity than the web connectors. One such method disclosed is to alter the thickness of the bosses/platforms versus the web connectors. And another method is to provide the bosses/platforms with stiffening geometry that provides a greater degree of rigidity than the web connectors. Such stiffening means could be the addition of one or more returns or ribs. Another is to make the bosses/platforms out of a different material than the web connectors. And another is to construct the webs with a geometry that acts as a hinge. Yet another is to make the given geometry out of a material that can exhibit stretch in addition to flexure. The invention also provides greater airflow to contact areas of the occupant's body, because foam is not necessary to create a comfortable seating surface. Additionally, the seating surface is more efficient and economical to produce.

So, an object of the present invention is to provide a new and improved method of chair seat and back pan construction, which provides greater comfort for the user. A further object of the invention is to provide a new and improved method of chair seat back pan construction, which provides superior surface adjustment for a variety of users. A further object of the invention is to provide a new and improved method of chair seat back pan construction, which provides greater airflow to contact areas of the occupant's body. A further object of the invention is to provide a new and improved method of chair seat back pan construction, which is more efficient and economical to produce.

LIST OF REFERENCE NUMERALS USED IN THE FIGURES

2—Seat frame
4—Back frame
6—Resilient seat surface insert
8—Resilient back surface insert
10—Mounting groove of 2
12—Mounting groove of 4
14—Arm support structure
16—Arm pads
18—Web connectors of 6/8
20—Thickened support sections, or bosses/platforms of 6/8
22—Openings of 6/8
24—Zone of greatest flexibility
48—Tension adjustment knob

DETAILED DESCRIPTION OF THE INVENTION

While the invention will be described in connection with a preferred embodiment, it will be understood that I do not intend to limit the invention to that embodiment. On the contrary, I intend to cover all alternatives, modifications and equivalents within the spirit and scope of the invention.

Figure 9:
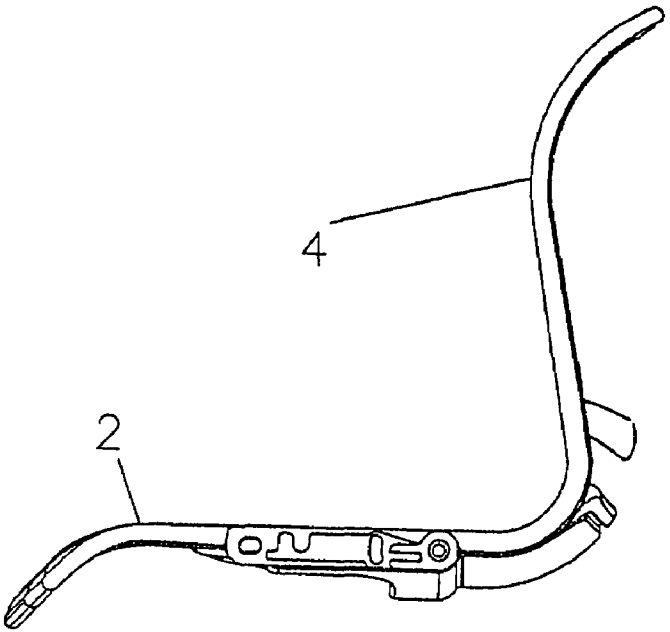
FIG. 9 is a side view of the seat-pan frame and the backrest frame, which is capable of receiving the seating surfaces of, figures three through six.
Figure 10:
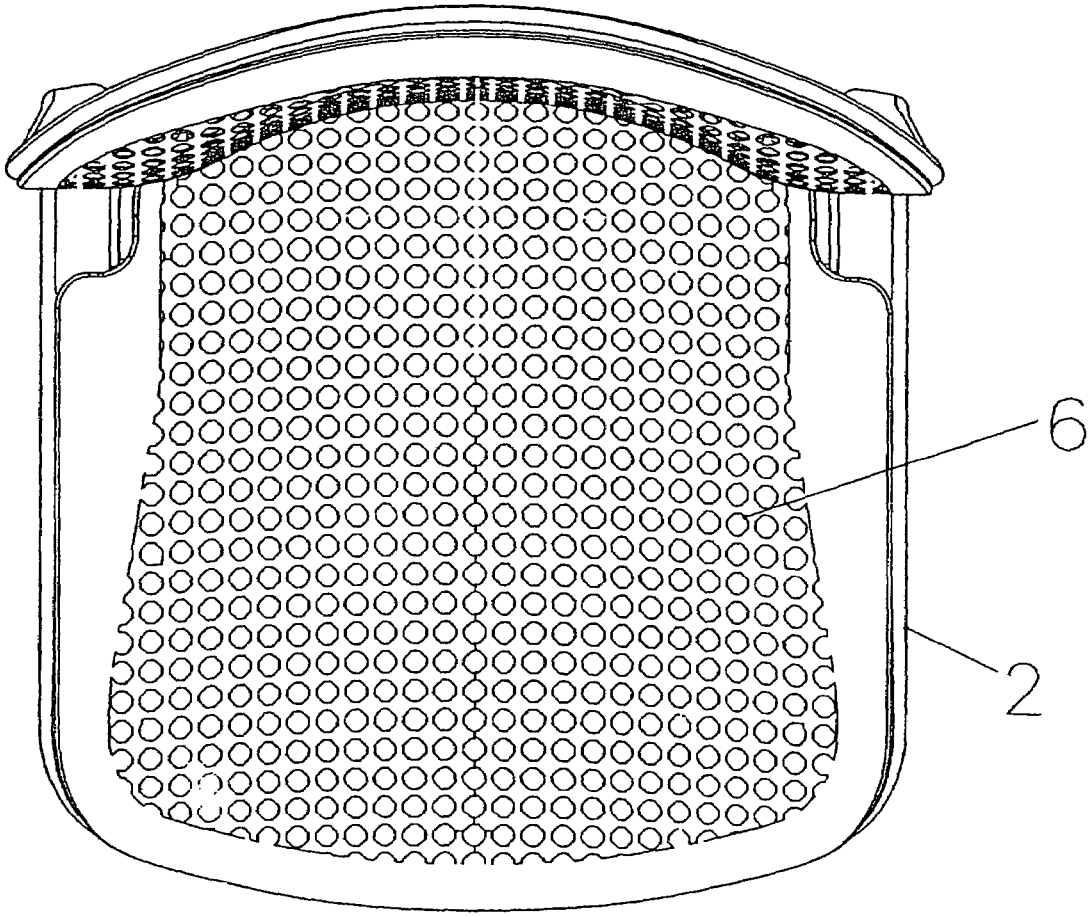
FIG. 10 is a top view of the seat-pan frame and the backrest frame with the resilient seating surfaces of figures three through six affixed in place.
Figure 11:
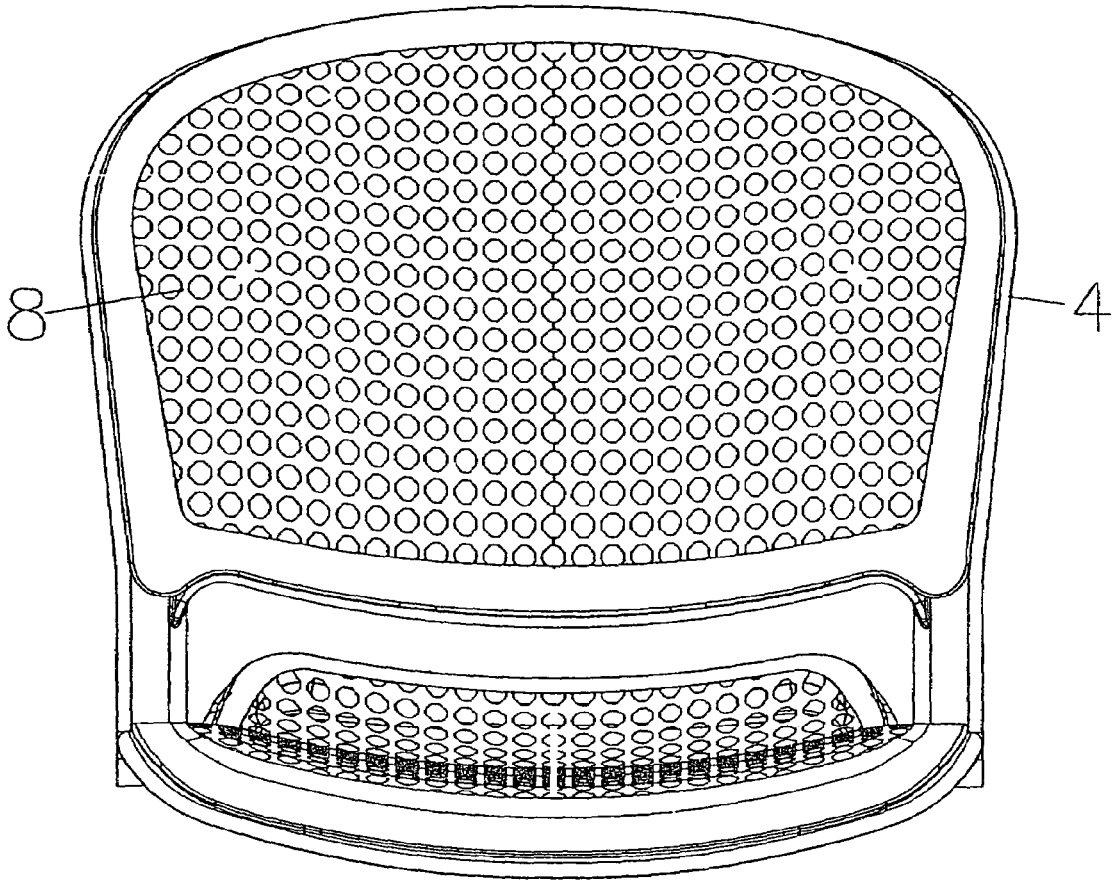
FIG. 11 is a front view of the seat-pan frame and the backrest frame with the resilient seating surfaces of figures three through six affixed in place.
Figure 12:
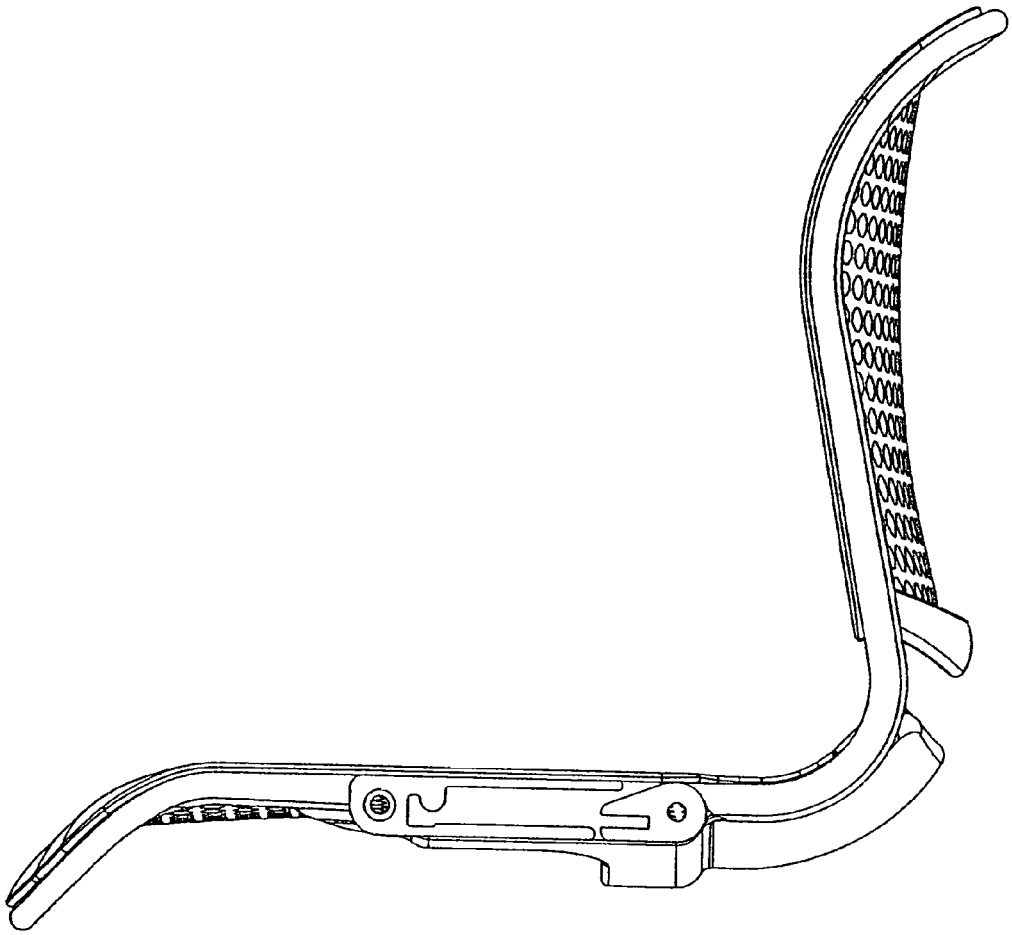
FIG. 12 is a side view of the seat-pan frame and the backrest frame with the resilient seating surfaces of figures three through six affixed in place.
Figure 13:
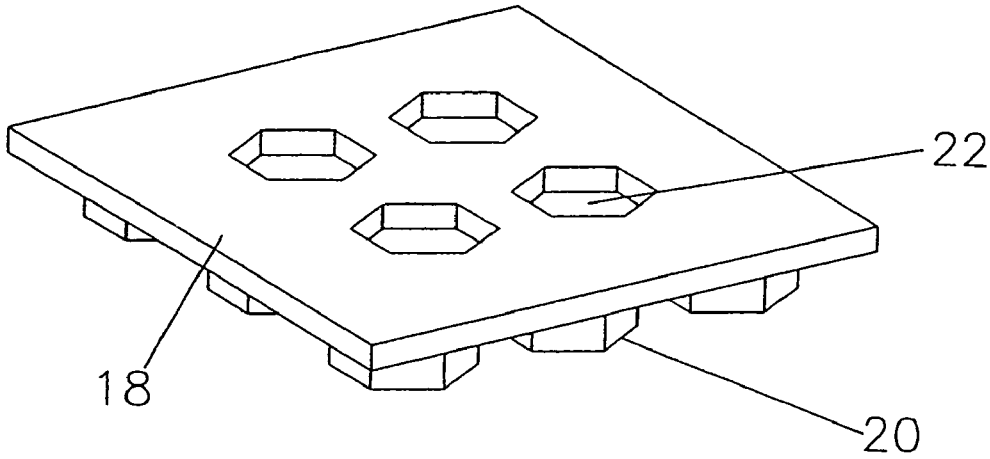
FIG. 13 is a detail view consisting of a substantially flat web.

Referring to FIG. 10 a top view of the seat-pan seating surface and its support frame can be seen. And by referring to FIGS. 3–6, the shells or pans can be seen separate from the frames, and the frames can be seen separate from the seating surface shells or pans in FIGS. 1,2,7,8, and 9. Also, it should be noted that a separate peripheral support frame is not a necessity of the invention, for the shells could be self-supporting with an integral structure. Additionally for clarification, a seat-pan, or back-pan seating surface refers to a structure which may be the primary surface, as in a plastic or wood chair, or a structure which may accept foam and upholstery and thus not be the primary surface as can be commonly found in many articles of furniture. Often these structures are also referred to as seating shells. All of these and any other terms used to describe a similar structure are considered to be equivalents and should be viewed as such.

Figure 1:
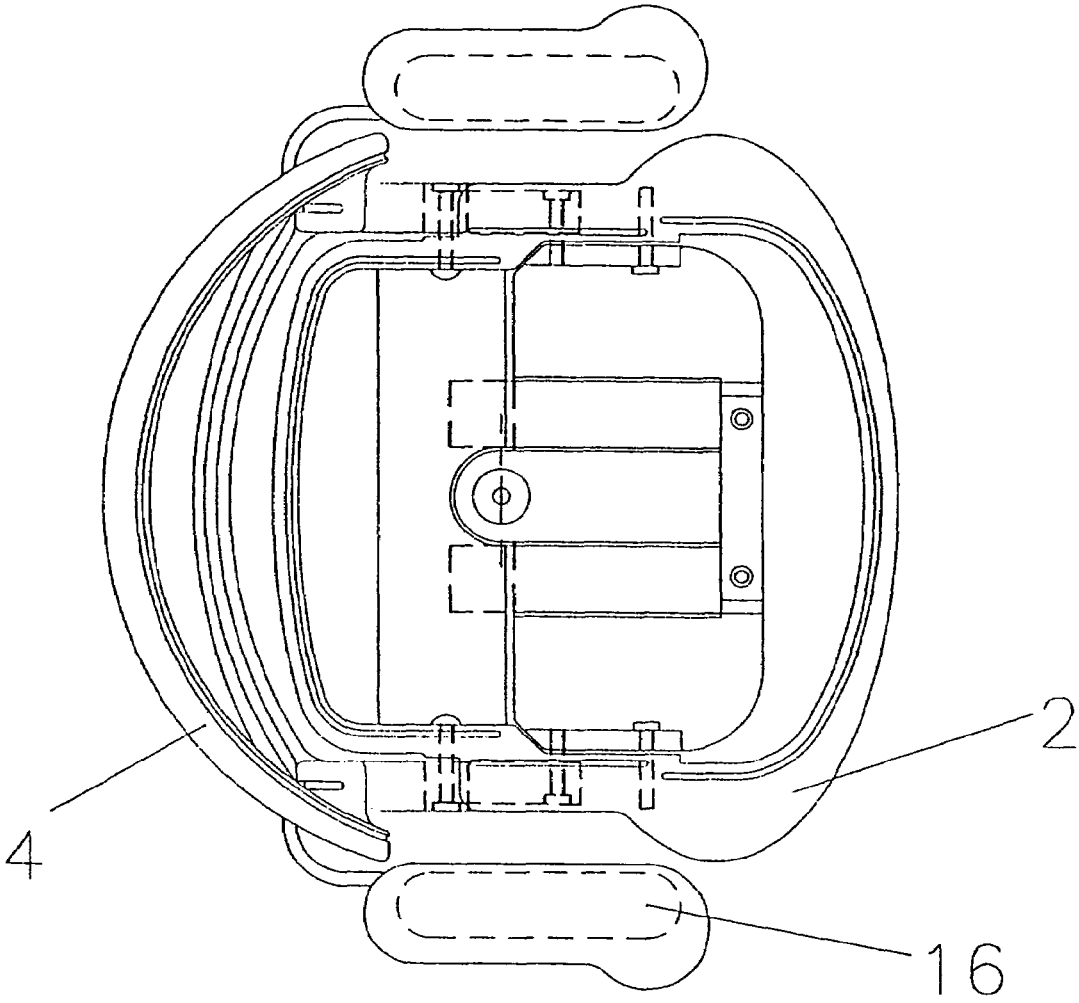
FIG. 1 is top view of the chair showing its support frame with its seat-pan seating surface removed.
Figure 2:
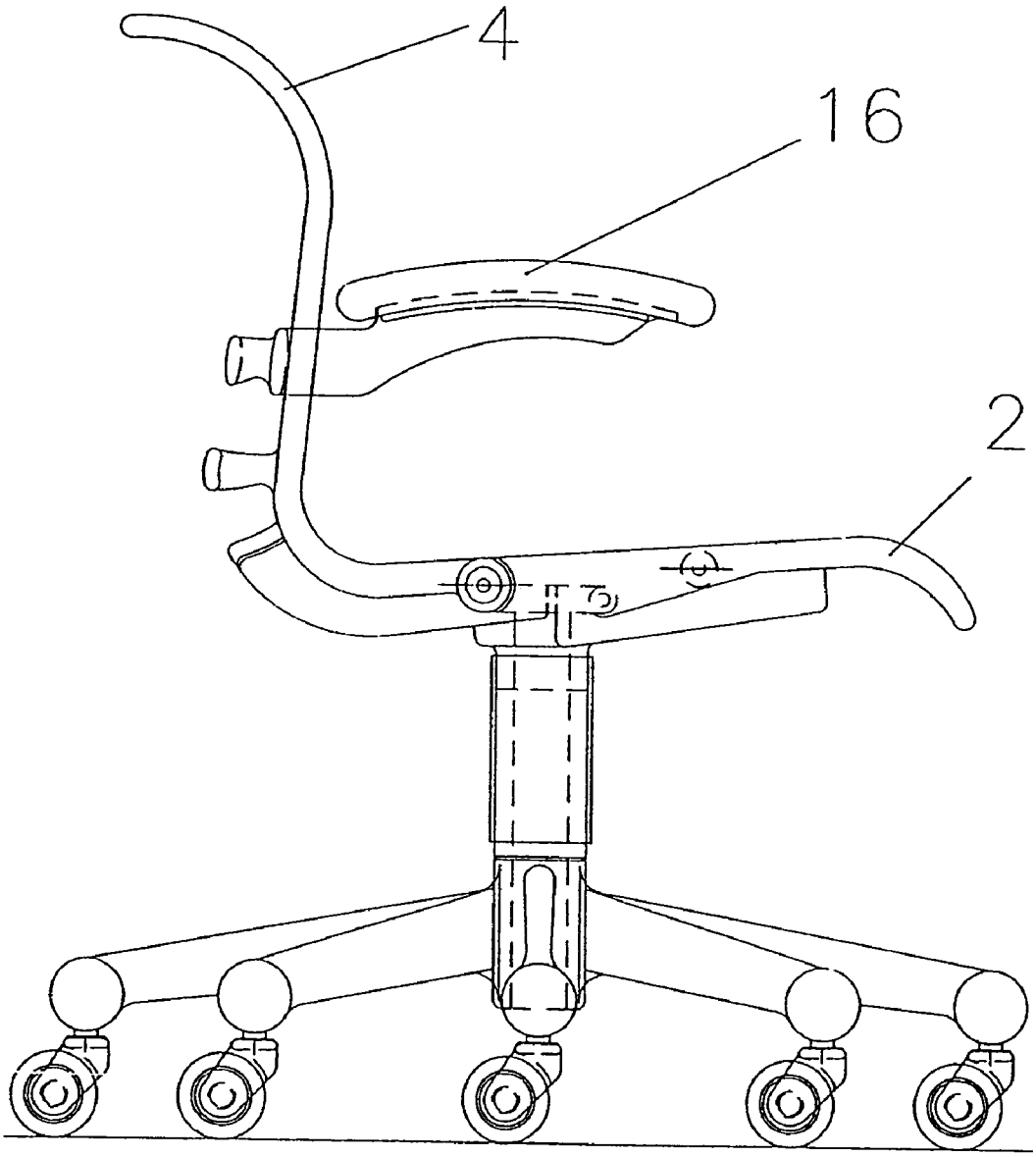
FIG. 2 is a side elevation of the chair according to the present invention.
Figure 3:
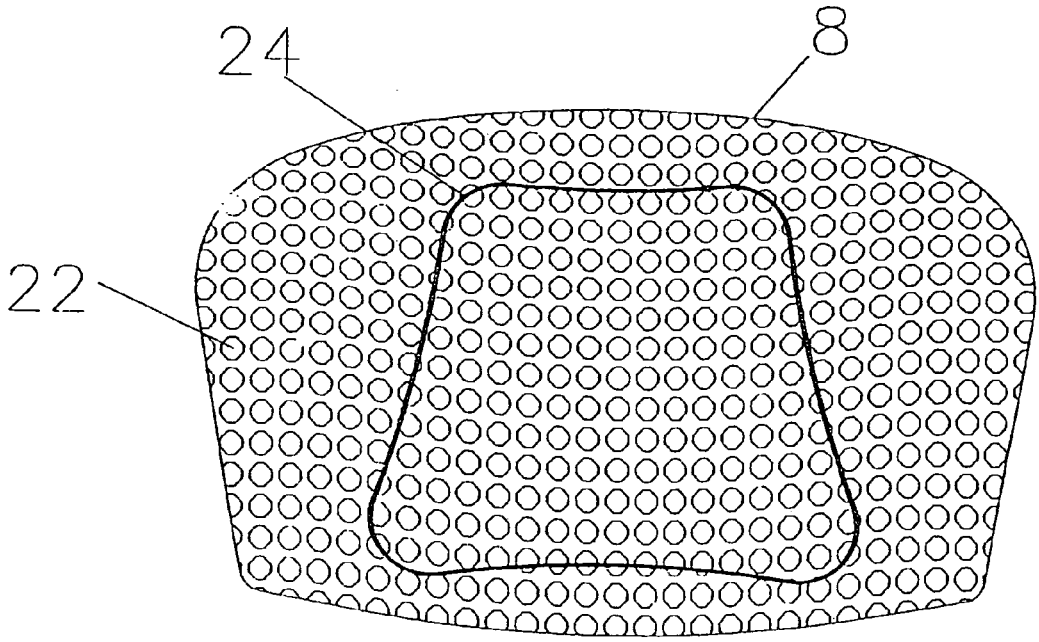
FIG. 3 is a front view of the back resilient seating surface.
Figure 4:
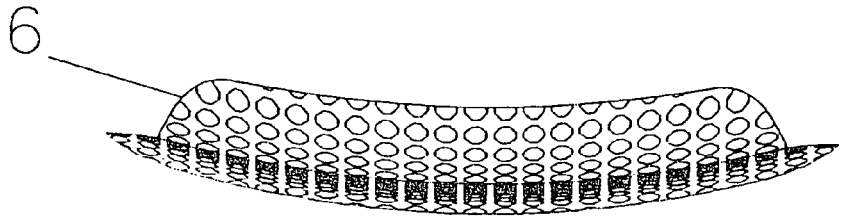
FIG. 4 is a front view of the resilient seat-pan seating surface.
Figure 6:
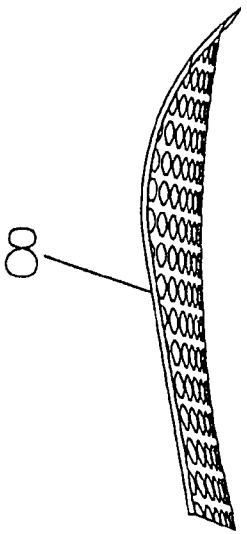
FIG. 6 is a side view of the back seating surface of figure three.
Figure 5:
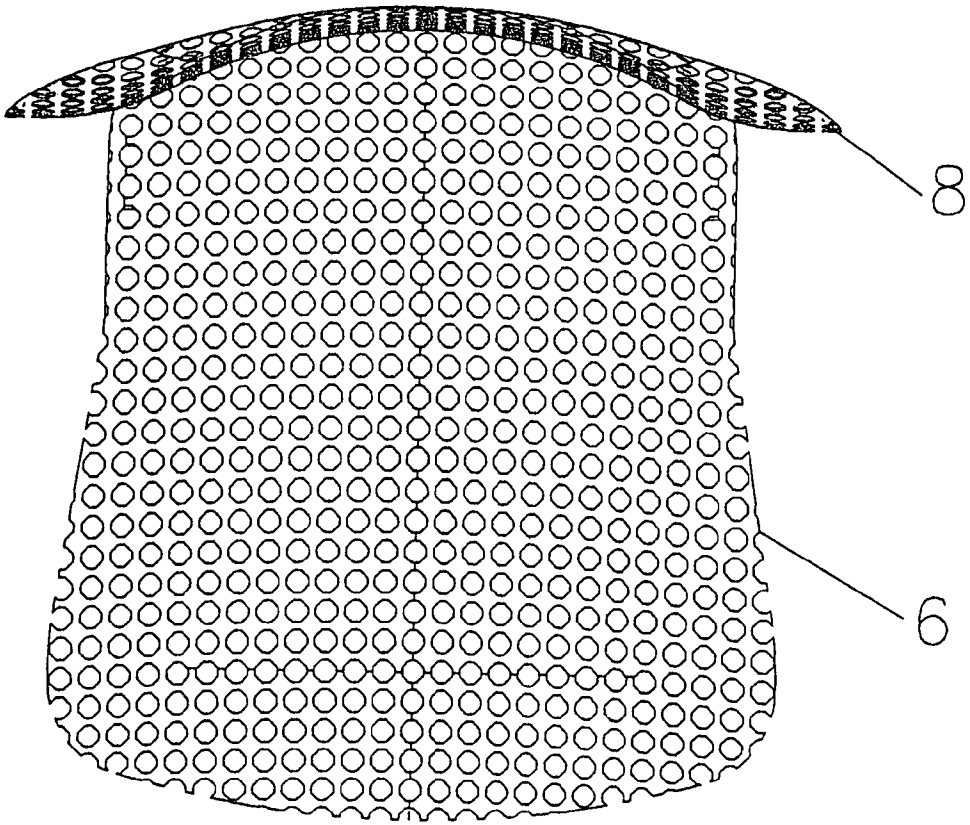
FIG. 5 is a top view of the back seating surface and seat-pan seating surface of figures three and four.

Now referring to FIGS. 3 and 4 it can be seen that the seating surface is comprised of a plurality of webs 18, thicker sections, or bosses/platforms 20, and openings 22. It is through the various geometric combinations of the three of these basic elements that improved seating comfort is achieved. This is why we also refer to the matrix as being "cellular" in nature, for it is a matrix of individual, independently acting cell structures. One embodiment has all three of these structures formed economically from one type of material and process such as plastic and molding. Any of the common molding methods known could be used including, but not limited to, injection, blow, or roto-molding. Additionally, through the use of advanced plastic injection molding techniques known to those in the industry as "two-shot" injection molding and "co-injection" molding, these elements may be selectively made from two or more types of materials to further control the overall engineering attributes of the structure. Additionally, this structure could be realized through other manufacturing techniques such as lamination, stamping, punching etc.

Figure 14:
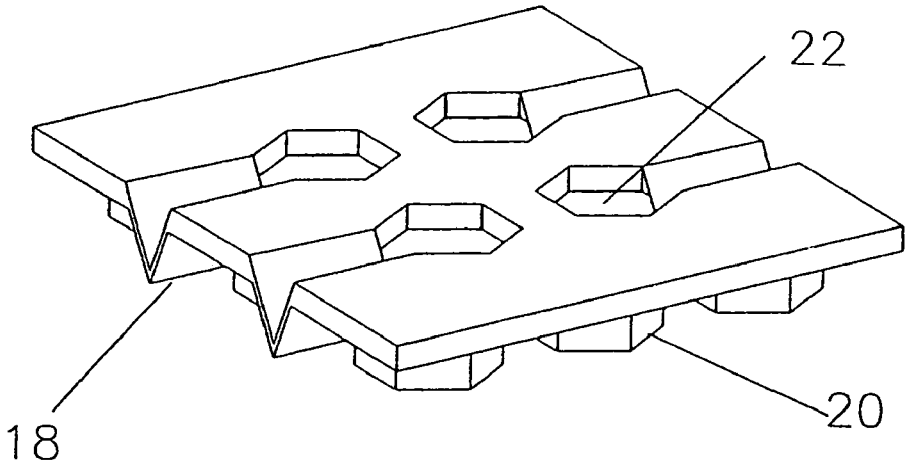
FIG. 14 is a detail view consisting of a configured web that has a V-shaped cross-section.
Figure 15:
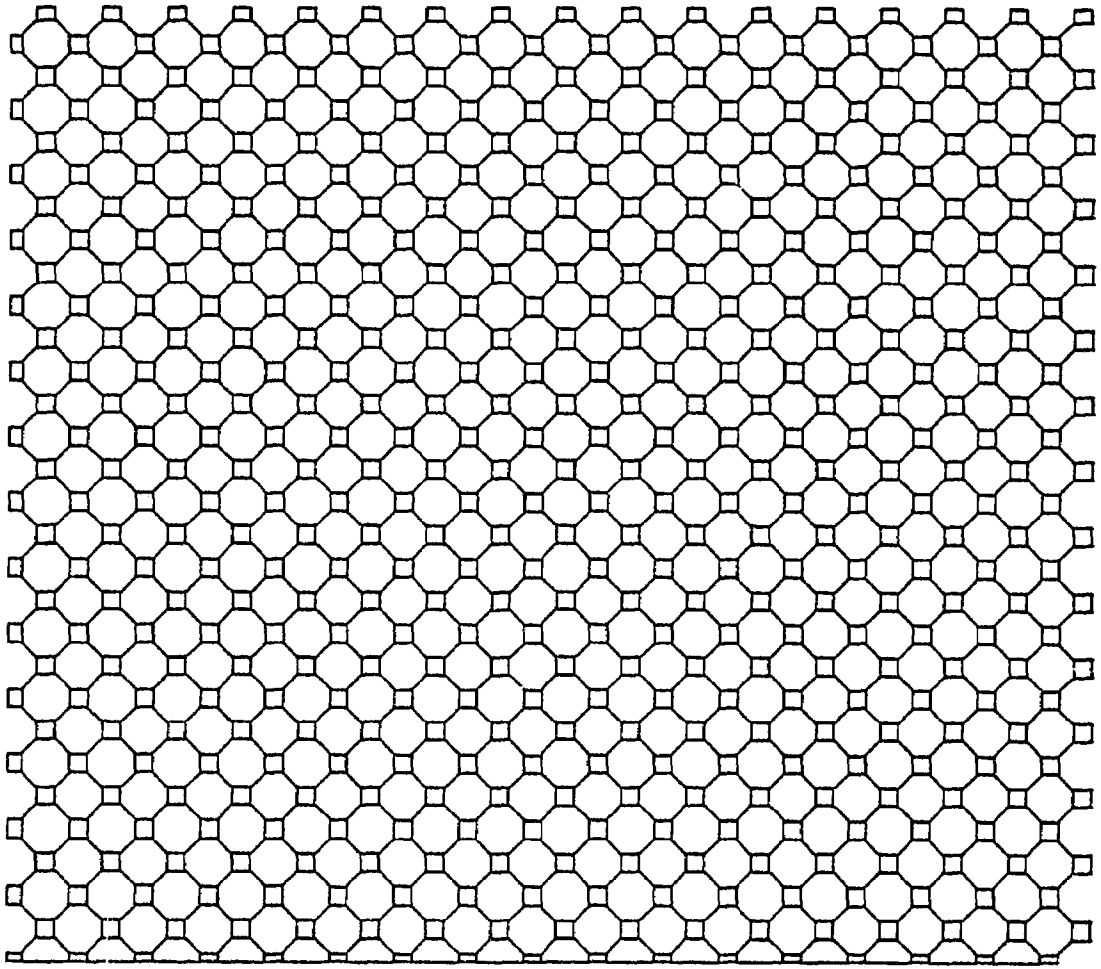
FIG. 15 is a plan view of the webbing structure.
Figure 16:
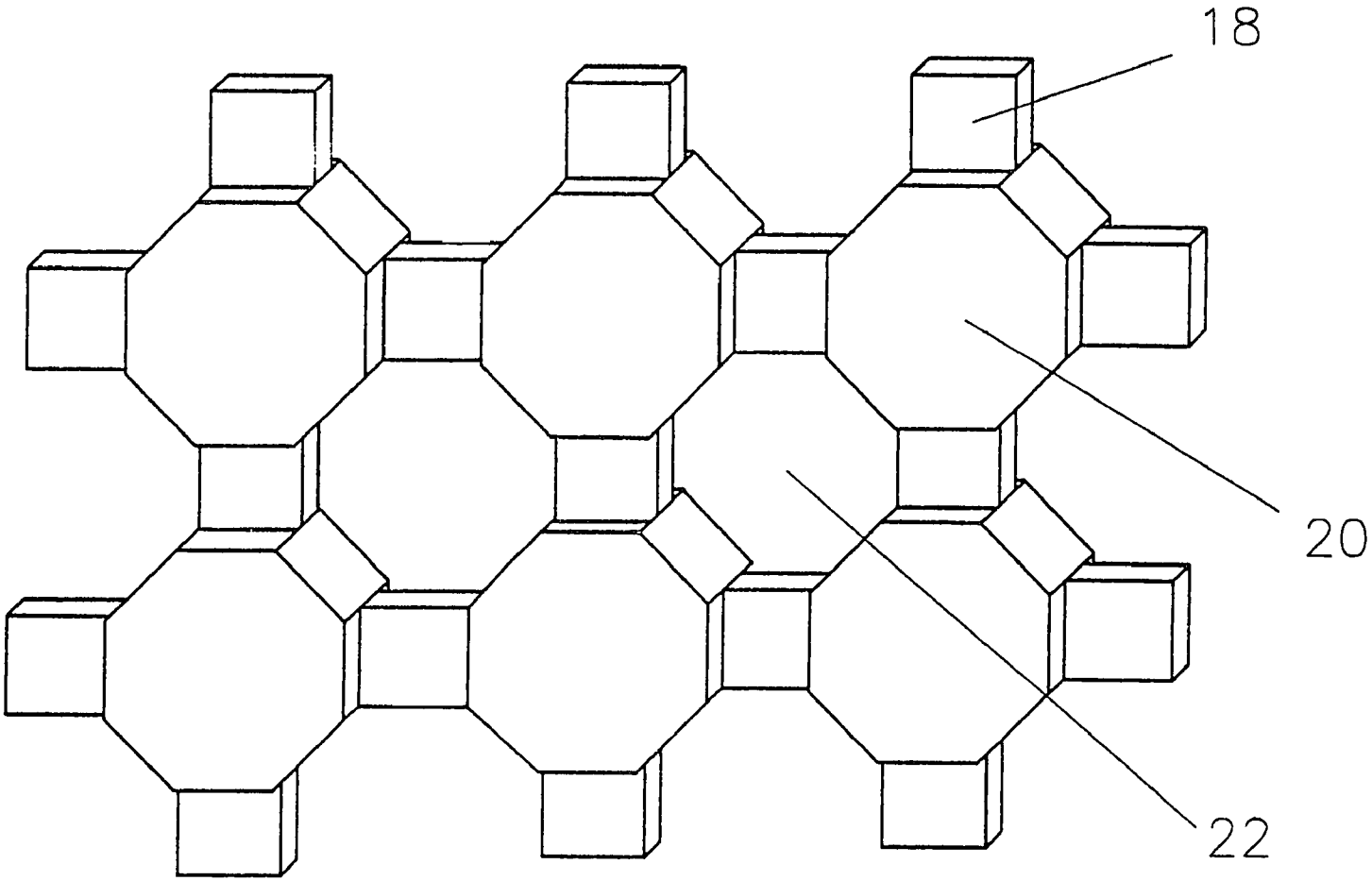
FIG. 16 is a detail anoxemetric view of FIG. 15, showing one form the web may assume.

Referring to FIG. 16, a closer view of some of the matrix, it can be seen that the webs 18, function as thinner or more flexible interconnecting elements to the thicker or more rigid bosses/platform sections 20. It is through these webs that flexure occurs, allowing movement of one thicker or more rigid section relative another thicker section. Depending upon the final geometry selected this movement may have several degrees of freedom. For example, if the web is of the form as in detail FIG. 16, where the web is predominantly flat in form, the web may act as a both a torsional flexure (occurring predominantly across the webs width) for the thicker or more rigid bosses/platform sections, as well as a linear flexure along its length. Additionally, depending on the characteristics of the materials used, the web may stretch in length, allowing another form of displacement. If, however, the web is of the form found in detail FIG. 14, where the web is formed as a V, or an inverted V, the web may exhibit the preceding characteristics as well as act as a living hinge allowing the angle formed by the faces of said V to change. This would result in a different set of degrees of freedom of one boss/platform section relative to another. Both of the aforementioned forms of webs, and other contemplated designs, all may share common types of flexure of varying degrees. It should be noted that the terms "thinner" and "thicker" sections are interchangeable with the terms "sections having greater" or "sections having less" flexibility relative to each other. Cross-sectional area or thickness is but one way of varying the relative rigidity of the webs vs. the bosses or platforms. Another way is to provide the bosses or platforms with rigidizing returns, ribs or walls, so that structurally the bosses or platforms are stiffer than the joining webs. Additionally, as stated earlier, the materials selected could play an important role in the performance of the geometry. For example, if the material selected is an elastomeric material, such as a urethane, the webs 18 could each stretch or elongate a small amount resulting in or allowing deflection or displacement of the thicker or more rigid bosses/platform sections 20. Another flexible material under consideration is Hytrel® polyester elastomer by Dupont. By each area responding individually the entire seating surface may emulate a soft cushioning effect to the occupant. As also mentioned earlier, it is possible through advanced molding techniques or fabrication, to use more than one type of molded material in a finished product. One such technique is to mold a part in one material in one mold and then place the part into another mold that has additional cavity area, and then fill that mold with another type of material. So it may be advantageous to for example to mold all the webs and connective areas in one material in one mold, and then to transfer the part to another mold to form all the thicker or more rigid bosses/platform sections and other features in another material.

Figure 17:
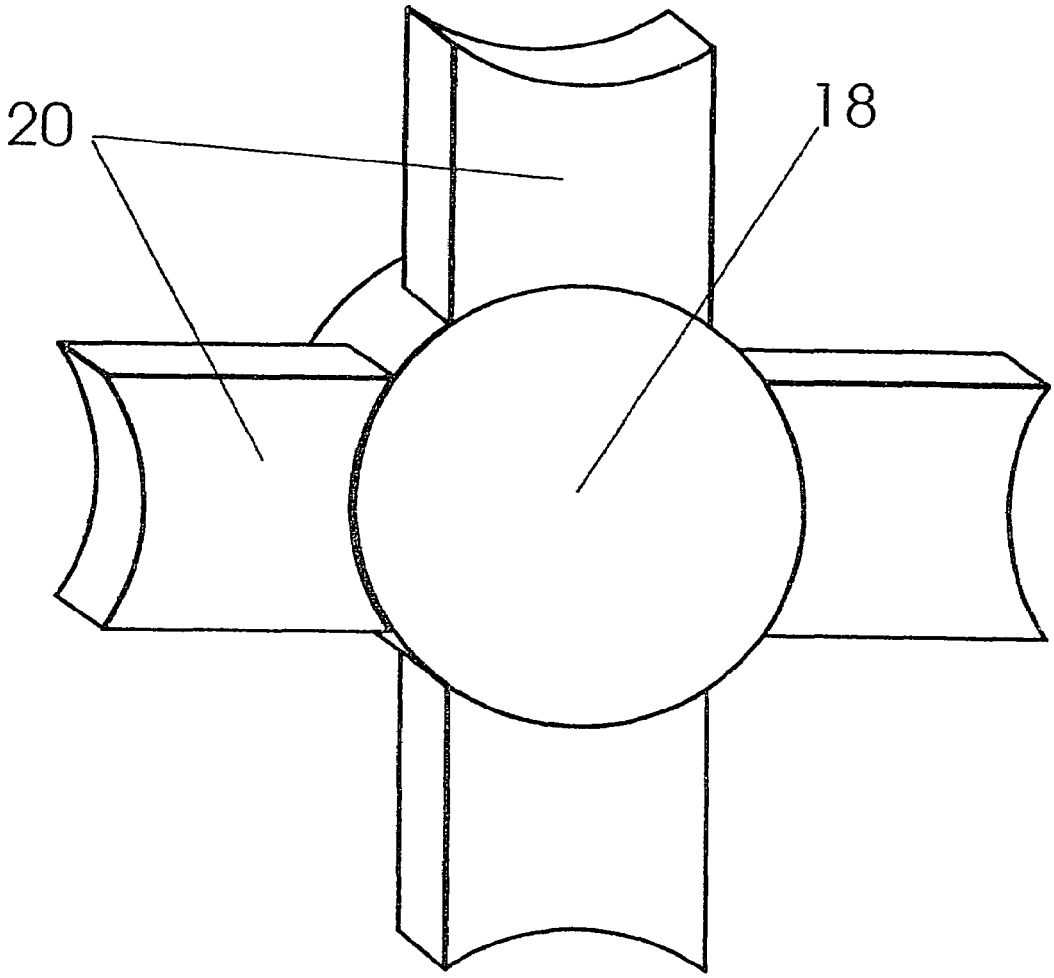
FIG. 17 is a detail anoxemetric view much like FIG. 16, except a single structural relationship is depicted, showing another form the web may assume.
Figure 18:
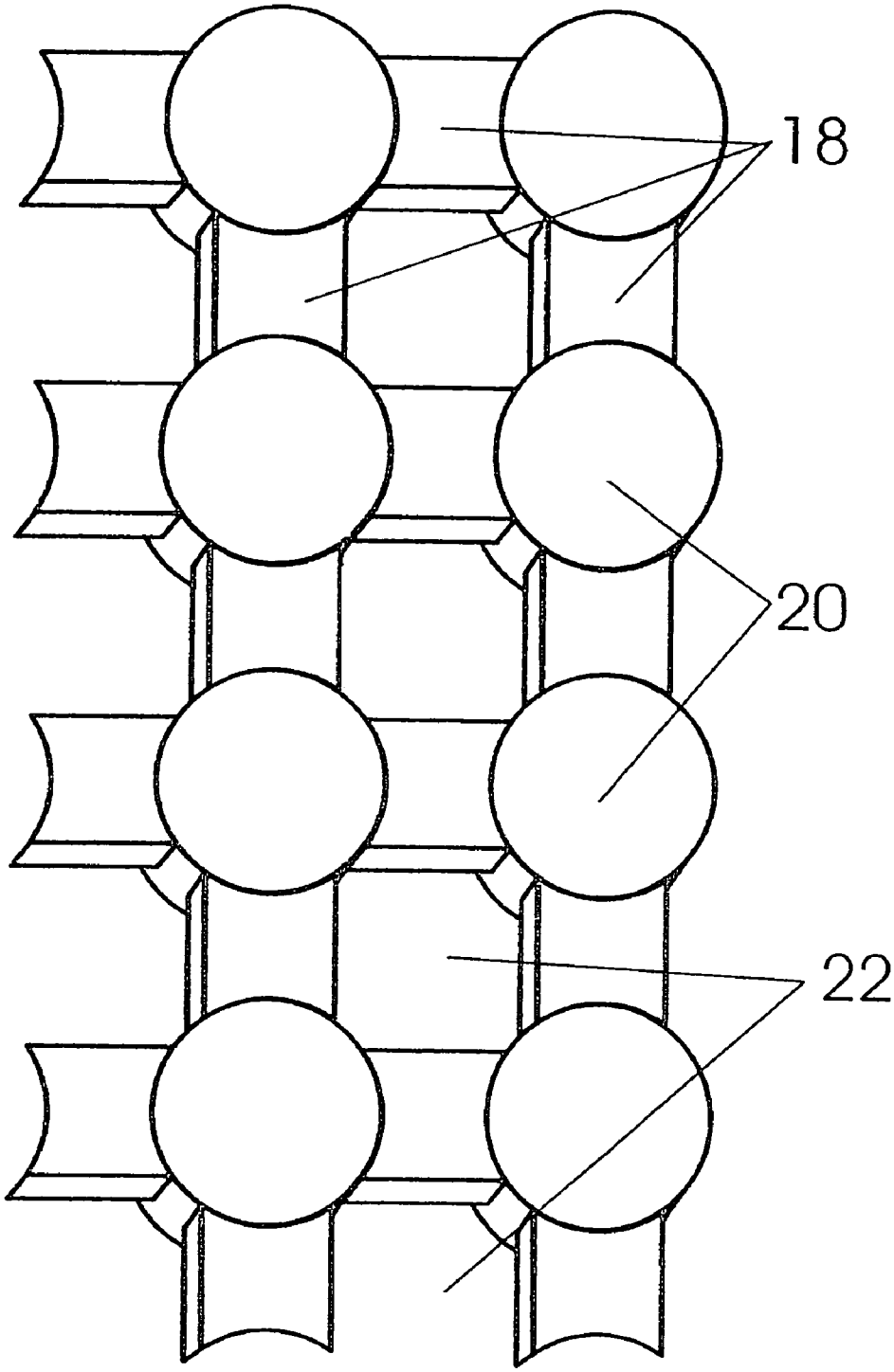
FIG. 18 is a detail anoxemetric view much like FIG. 16, showing several cells linked together.
Figure 19:
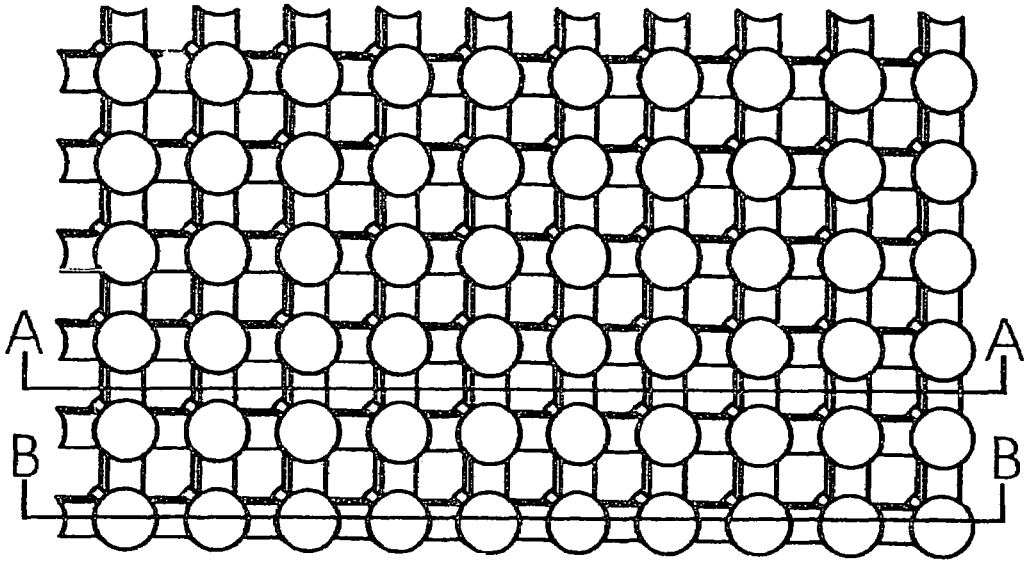
FIG. 19 is a detail anoxemetric view much like FIG. 18, except a larger field of structural relationships is depicted.
Figure 20:
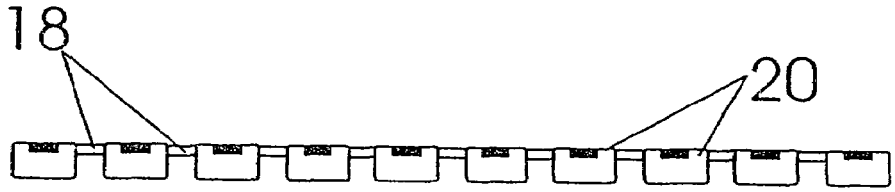
FIG. 20 is a side sectional view taken along cutting line A—A of FIG. 19.
Figure 21:
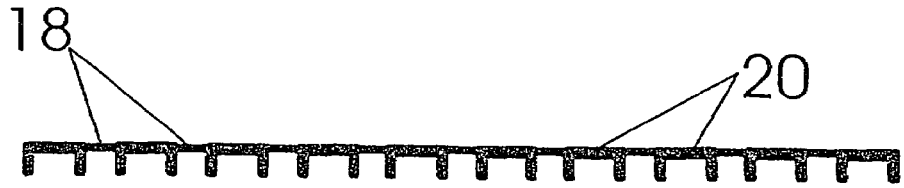
FIG. 21 is a side sectional view taken along cutting line B—B of FIG. 19.

Because the platforms are joined by webs, holes, or areas lacking material are created which allow airflow and thus reduces the amount of heat build up on the seating surface. These holes, or areas with no material, further serve to allow the desired movement of the webs and the thicker sections. As shown, the holes are octagons, but any shape found suitable could be used. Referring to FIG. 17, a detail anoxemetric view much like FIG. 16, except a single structural relationship is depicted, showing another form the web structure may assume. The difference of this form of web structure can be appreciated by referring to FIGS. 19, 20, and 21. Rather than the bosses/platforms being thicker in cross-sectional than the web connecting members, the bosses/platforms are provided with structural returns or reinforcing ribs. Thus functionally, the bosses/platforms will have a greater structural rigidity relative to their interconnecting web members. FIG. 20 which is a sectional view taken along cutting line A—A of FIG. 19 and FIG. 21 which is a sectional view taken along cutting line B—B of FIG. 19, show that the bosses/platforms have reinforcing returns that make the bosses/platforms more rigid than the connecting web structure. As shown the return wall on the bosses/platforms forms a ring. This is not a necessity though, the returns could be as simple as a single rib or as complex or as many returns as are needed.

A critical aspect of this invention is the ability of the designer/manufacturer to precisely control and alter all aspects of the deflection of the seating surface from area to area simply and controllably. When a designer/manufacturer specifies a foam density (firmness/softness) for a cushion, the entire cushion is compromised by that unifying density. That is not the case with this invention though.

Biomapping is datum created through the comparison of body contours of a given population, or the datum created through the comparison of contact forces exerted between a seating surface and the occupant. Although exercises in generating data have been ongoing for several years, the designer is still limited to selecting generic contours, and then hopes that the foam would resolve the final fitting issues. This invention, however, makes it possible to effectively use the data generated by biomapping to precisely control the geometry (web-connectors, bosses/platforms, and openings) and thus the engineering properties area by area over the entire seating surface, so that each sector-area is functionally optimized.

So it should be appreciated that by varying the size and shape of the holes, the location of holes, the types of webs and their relative thickness, or geometry and the size, contour and relative thickness of the thicker sections or their geometry, a designer can custom design each area of a seating surface to perform as desired. FIG. 3 shows how the seating surface could be divided into zones; one such zone is indicated by area 24. This could be the zone of greatest flexibility. It should also be appreciated the advantage this offers the designer when he is trying to economically manufacture an item from a material such as plastic, as well as the increased comfort that the user will experience.

Figure 7:
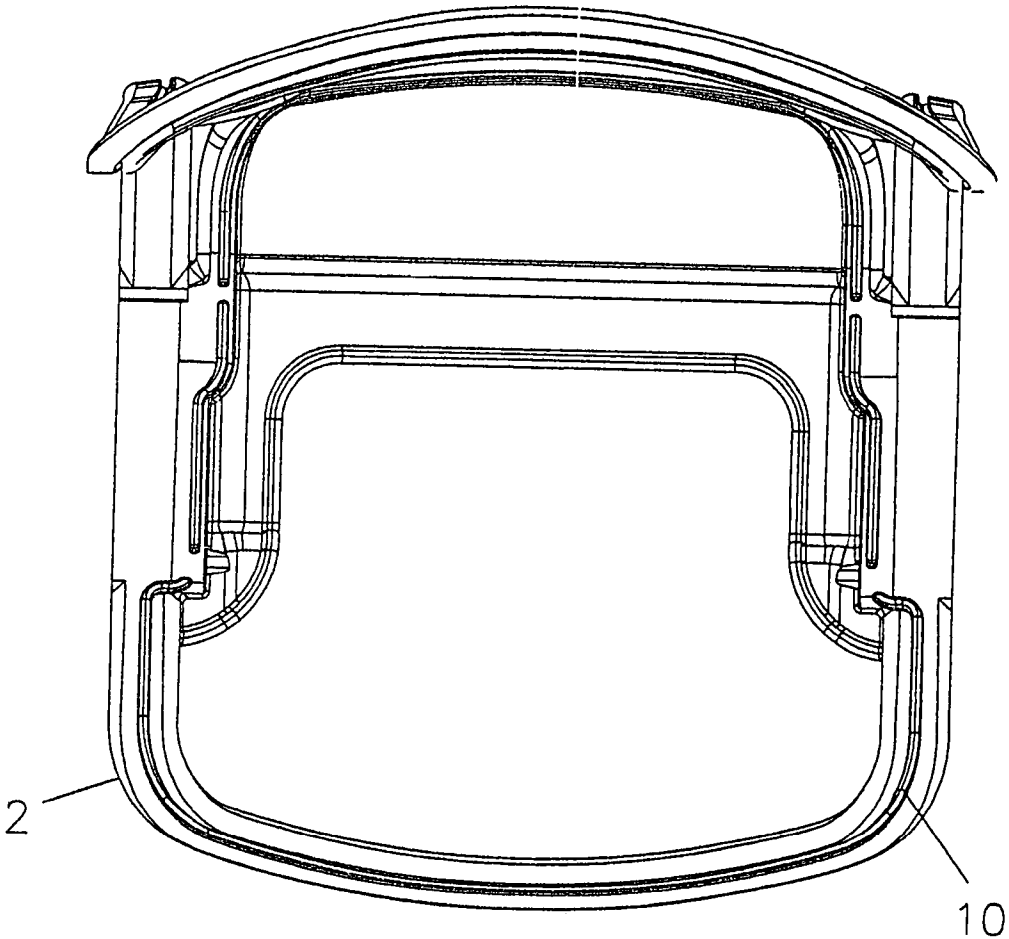
FIG. 7 is a top view of the seat-pan frame and the backrest frame that is capable of receiving the seating surfaces of figures three through six.
Figure 8:
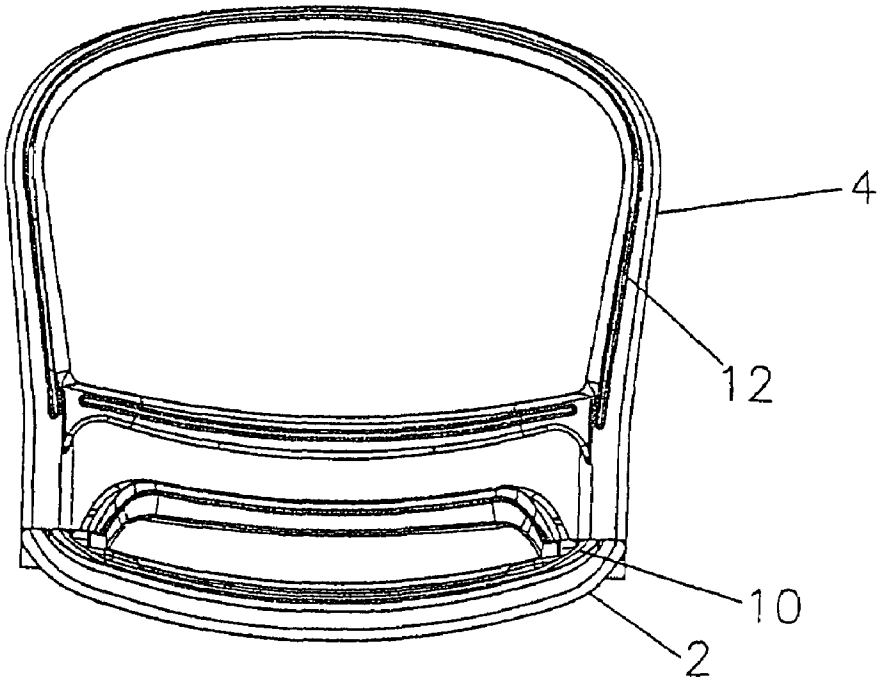
FIG. 8 is a front view of the seat-pan frame and the backrest frame that is capable of receiving the seating surfaces of figures three through six.

Referring to FIGS. 7–9 both the seating frame 2 and the back frame 4 can be seen. It is substantially more rigid than the seating surface. It provides a support structure for the seating surface, and as a means to connect the seating surface to the rest of the chair. In one contemplated embodiment the seating surface is carried within the seating frame by way of mounting grooves 10 and 12. It should be appreciated that the seating surface and the frame could be formed or manufactured as a single unit; however, several advantages may be realized if they are separate. One such advantage is that they may be made of differing materials. In this way, each of the materials selected for their respective part may be optimized functionally. Another advantage is that the way in which the two members, the seating surface and its frame, are attached may be variable. Techniques of manufacture and assembly could be used which would allow movement relative to one another. This would give yet more degrees of movement and cushioning to the occupant. An example of an attachment means is a rubber mount that may take the form of a series of intermediate mounting pads, which occur between the seating surface and its frame. Similarly, the rubber or resilient material could take the form of a gasket occurring between the seat surface and frame. Another way that such movement could be achieved is to produce a groove integral to the seating surface that would follow the same path as the mounting groove. Such a groove could be pleated like the web found in FIG. 14, and thus would allow a degree of lateral movement. Another method would be to have the seating surface snap into place using tabs and slots that had enough free-play relative to each other to yield desirable results. Either the seating surface or the frame could have the slots and the other the tab members. Yet another method would be to configure the two elements so that one or the other had standing legs formed predominantly perpendicular to the other element. In this way, when the two are assembled, and allowed to shift relative to each other, the legs flex. This, like the rubber or resilient mounts would allow biased relative movement, which would not feel loose. These tabs or the functionality of them could be combined with the snap tabs, as a matter of fact; any of the methods could be successfully combined. Additionally, any of these attachment techniques could occur using mounting grooves such as 10 and 12, or could surface mount directly on the surface of the seat/back frames. It is also contemplated that the entire assembly (frames, resilient seating surface inserts, and flex gasketing material) could be manufactured using the advanced multi-material molding techniques (two-shot, co-injection) previously mentioned. This would have the potentially obvious advantages of increased economy, and ease of manufacture, and increased structural integrity.

Another critical feature of the invention in regard to the way in which the seating surfaces interact with the seating frame concerns sizing. As previously mentioned, it is a handicap to the designer to try to design a chair with the proper contours for the full range of the population. The resulting designs and contours are necessarily compromises, and thus are not optimal for any given individual. As also previously mentioned, in an effort to overcome these limitations, manufacturers have produced "sized" (i.e. small, medium and large) chairs that effectively narrow the amount of contouring-compromise that the designer must normally exercise. The fact of the matter is that there are several aspects to sizing. The first, and most obvious, is the overall sizing of the surfaces as far as width, height etc. As far as comfort is concerned, this is the least important aspect of seating surface design. Appropriately sized seating surfaces can be formulated that satisfy the extremes. What is most important in achieving seating comfort, is the contouring that occurs within whatever sized seating surface is chosen. Unfortunately, this contouring varies greatly from a small individual, to a large one. Additionally, some individuals who seemingly share the same body types prefer differing contours such as stronger/weaker lumbar contours. Although the present invention addresses this need for variable contouring through its innovative flexure structure, further advantages in comfort can be realized if the initial contours of the seating structure are in the proper range for the occupant. Through the present invention's unique method of construction, these goals are all achievable. As previously outlined, the seating surfaces can be attached to the seating frame by a variety of methods. So, the manufacturer can produce one basic chair frame(s) and then into the same set of frames insert many different contoured seating surfaces. Obviously, this has the advantage of eliminating the need of the manufacturer having to tool three independent products instead of one. It also has additional advantages. Because the seating surfaces are so easily attached and detached from their frames, it is conducive to a field-customization scenario. In this way, wholesalers, and retailers could stock frames, and then have a variety of seating surfaces in various contours and colors. This would allow the retailer could customize the product on the spot for the customer. Additionally, the end user is not stuck with a chair that at some point in the future may be the wrong size. The size/color scheme can be updated at any point of the products life by simply obtaining a fresh set of seating surfaces.

Thus, a new and improved method of chair seat and back pan construction, which provides greater comfort through superior surface adjustment for a variety of users, has been provided. Also provided is a new and improved method of chair seat back pan construction that provides greater airflow to contact areas of the occupant's body. Also provided is a new and improved method of chair seat back pan construction that is more efficient and economical to produce.

What is claimed is:

1. A seating structure comprising:

a plurality of boss structures arranged in a pattern;

a plurality of web structures joining adjacent boss structures within said pattern, wherein at least some of said web structures are non-planar, and wherein said boss structures and said web structures are integrally formed as a unitary structure; and wherein each of said boss structures has a body-facing surface, wherein said web structures are spaced apart from said body-facing surface, with said body-facing surface being more proximal to an occupant than said web structures when the occupant is supported by the seating structure, wherein at least some adjacent non-planar web structures defining said plurality of web structures are spaced apart such that said spaced apart adjacent non-planar web structures define openings therebetween and between said adjacent boss structures, and wherein said openings have a non-planar periphery defined at least in part by edge portions of said adjacent non-planar web structures.

2. The seating structure of claim 1 wherein said plurality of boss structures and said plurality of web structures define at least in part one of a seat and back, and wherein said pattern comprises rows and columns of said boss structures extending in substantially perpendicular directions respectively.

3. The seating structure of claim 1 wherein each of said boss structures has a body-facing surface, wherein said body-facing surfaces of at least some of said plurality of boss structures are substantially circular.

4. The seating structure of claim 1 wherein said web structures are thinner in section than said boss structures.

5. A seating structure comprising:

a plurality of boss structures arranged in a pattern;

a plurality of web structures joining adjacent boss structures within said pattern, wherein at least some of said web structures are non-planar; and wherein each of said boss structures has a body-facing surface, wherein said web structures are spaced apart from said body-facing surface, with said body-facing surface being more proximal to an occupant than said web structures when the occupant is supported by the seating structure, wherein at least some adjacent non-planar web structures defining said plurality of web structures are spaced apart such that said spaced apart adjacent non-planar web structures define openings therebetween and between said adjacent boss structures, and wherein said openings have a non-planar periphery defined at least in part by edge portions of said adjacent non-planar web structures, and wherein said boss structures comprise a first portion defining a body-facing support surface and at least one rib extending from said first portion in a direction away from support surface.

6. The seating structure of claim 1 wherein at least some of said boss structures are connected to a frame.

7. The seating structure of claim 1 wherein at least some of said web structures are connected to a frame.

8. A seating structure comprising:

a plurality of boss structures arranged in a pattern;

a plurality of web structures joining adjacent boss structures within said pattern, wherein at least some of said web structures are non-planar; and wherein each of said boss structures has a body-facing surface, wherein said web structures are spaced apart from said body-facing surface, with said body-facing surface being more proximal to an occupant than said web structures when the occupant is supported by the seating structure, wherein at least some adjacent non-planar web structures defining said plurality of web structures are spaced apart such that said spaced apart adjacent non-planar web structures define openings therebetween and between said adjacent boss structures, and wherein said openings have a non-planar periphery defined at least in part by edge portions of said adjacent non-planar web structures, and wherein at least some of said web structures are V-shaped.

9. The seating structure of claim 1 wherein said spaced apart adjacent web structures define substantially non-circular openings therebetween and between said adjacent boss structures when viewed in a direction substantially perpendicular to said support surface.

10. The seating structure of claim 9 wherein said non-circular openings are substantially hexogonal.

11. The seating structure of claim 9 wherein said non-circular openings are substantially rectangular.

12. The seating structure of claim 11 wherein said non-circular openings are substantially square.

13. The seating structure of claim 9 wherein said non-circular openings are substantially octagonal.

14. The seating structure of claim 9 wherein said boss structures and said web structures are integrally formed as a unitary structure.

15. A seating structure comprising:

a plurality of boss structures arranged in a pattern;

a plurality of web structures joining adjacent boss structures within said pattern, wherein at least some of said web structures are non-planar; and wherein at least some adjacent web structures defining said plurality of web structures are spaced apart such that said spaced apart adjacent web structures define openings therebetween and between said adjacent boss structures, wherein at least some of said web structures are V-shaped, with an apex of each of said V-shaped web structures located at a proximate mid-point between said adjacent boss structures joined by said V-shaped web structures.

* * * * *